United States Patent [19]

Keeton

[11] Patent Number: 4,501,209

[45] Date of Patent: Feb. 26, 1985

[54] CONSTRUCTION OF FLY PIECES FOR MEN'S BRIEFS

[76] Inventor: J. Herbert Keeton, 727 Meader Dr., Campbellsville, Ky. 42718

[21] Appl. No.: 426,144

[22] Filed: Sep. 28, 1982

[51] Int. Cl.[3] ..... D05B 21/00

[52] U.S. Cl. ..... 112/121.12; 112/121.14; 112/304; 112/306

[58] Field of Search ..... 112/121.14, 121.15, 112/121.12, 304, 306, 2

[56] References Cited

U.S. PATENT DOCUMENTS

| | | | |
|---|---|---|---|
| 2,625,127 | 1/1953 | Eckardt | 112/152 |
| 3,156,927 | 11/1964 | Grimm et al. . | |
| 3,160,124 | 12/1964 | Cash | 112/121.14 |
| 3,371,630 | 3/1968 | Cash | 112/121.14 |
| 3,680,509 | 8/1972 | Miller | 112/152 |
| 3,696,445 | 10/1972 | Craig . | |
| 3,699,591 | 10/1972 | Breitkopf et al. . | |
| 3,745,947 | 7/1973 | Brocklehurst . | |
| 3,779,186 | 12/1973 | Teed | 112/121.14 |
| 3,782,309 | 1/1974 | Lee . | |
| 3,839,973 | 10/1974 | Cummins et al. | 112/121.14 |
| 3,869,997 | 3/1975 | German . | |
| 3,896,749 | 7/1975 | Brauns et al. | 112/121.12 |
| 4,327,653 | 5/1982 | Blessing | 112/121.14 |

*Primary Examiner*—Ronald Feldbaum

*Attorney, Agent, or Firm*—Cushman, Darby & Cushman

[57] ABSTRACT

Fly pieces for men's briefs, or the like, are formed automatically, and are disposed in aligned pairs in a roll. Automatic sewing machine and trimmers are reciprocated in a dimension perpendicular to the direction of cloth feed to form the band-stitched arcuate side portions, and opposite side portions, of the fly pieces. A bunching-up mechanism acts upon the cloth to prevent wastage of banding material. Individual pieces of cloth that have been band-stitched are fed into face-to-face engagement, are moved in a vertical path, and taken up by a coiler. Partial severing the face-to-face cloth sheets into distinct fly pieces is accomplished just prior to the sheets being taken up on the coiler.

30 Claims, 14 Drawing Figures

Fig. 3
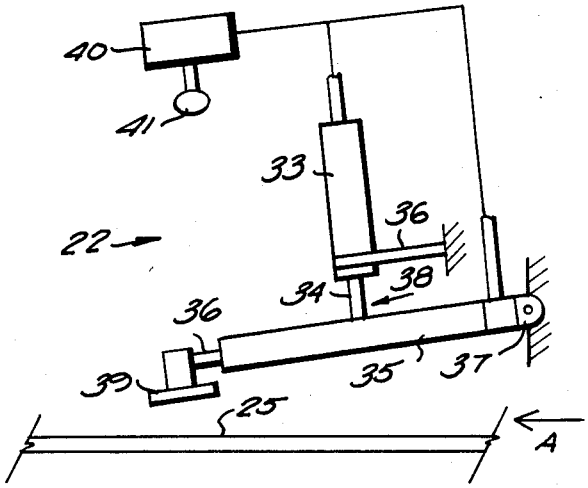
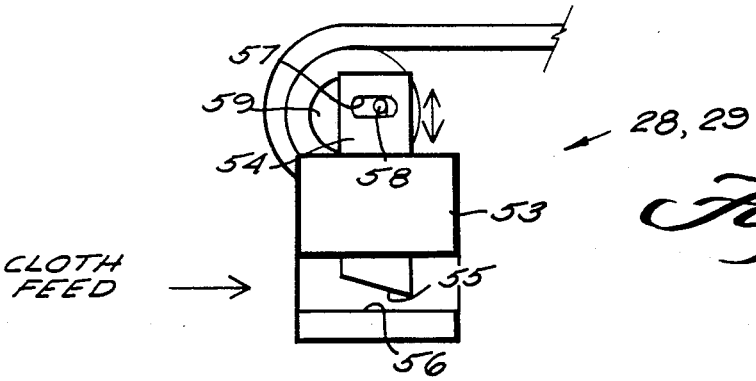
Fig. 5
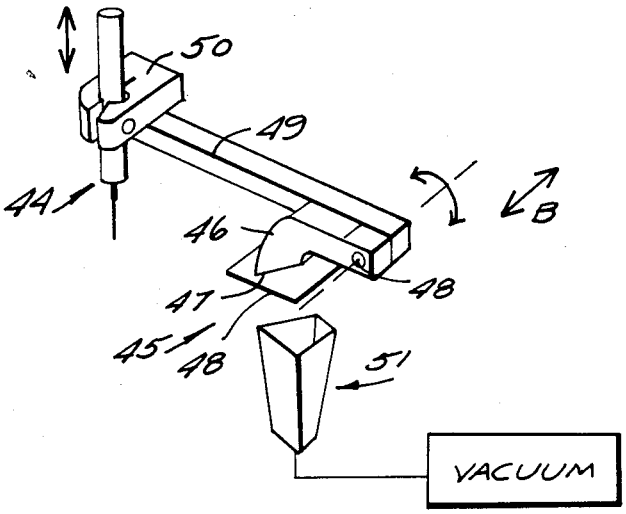
Fig. 4

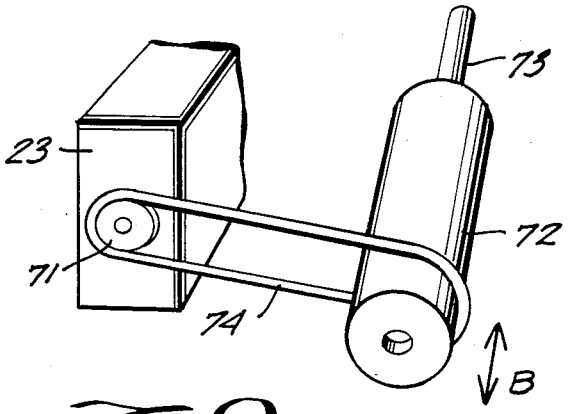
Fig. 9
Fig. 12
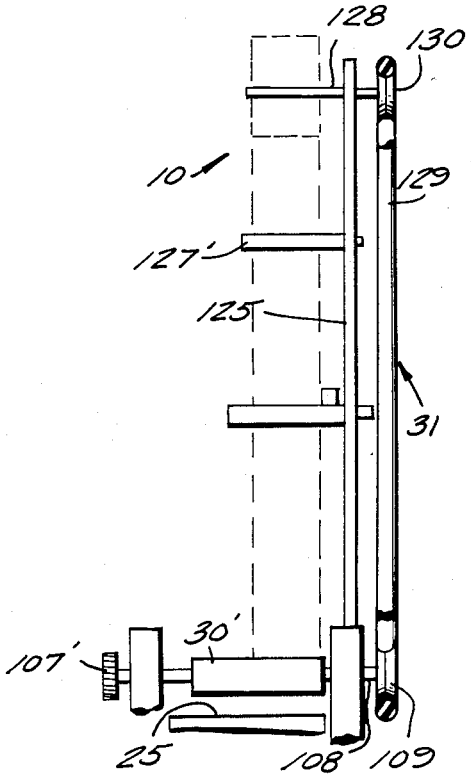
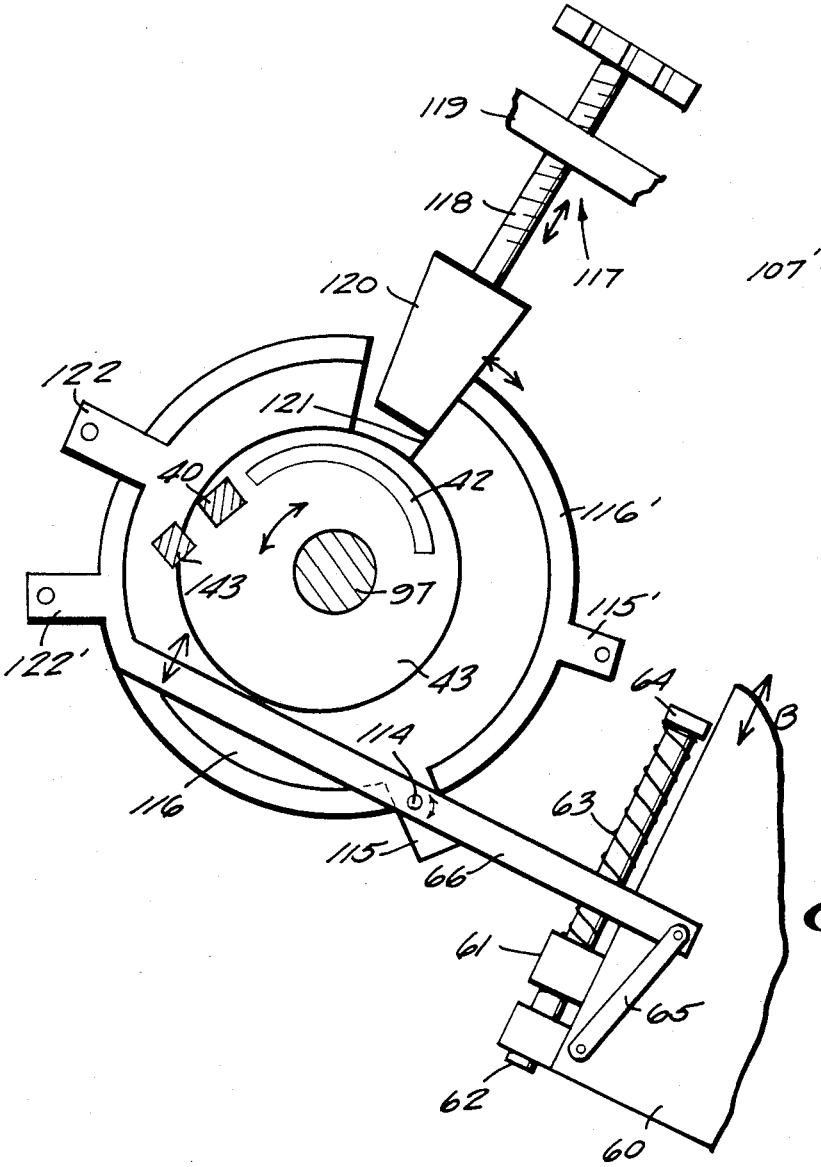
Fig. 11

Fig. 10
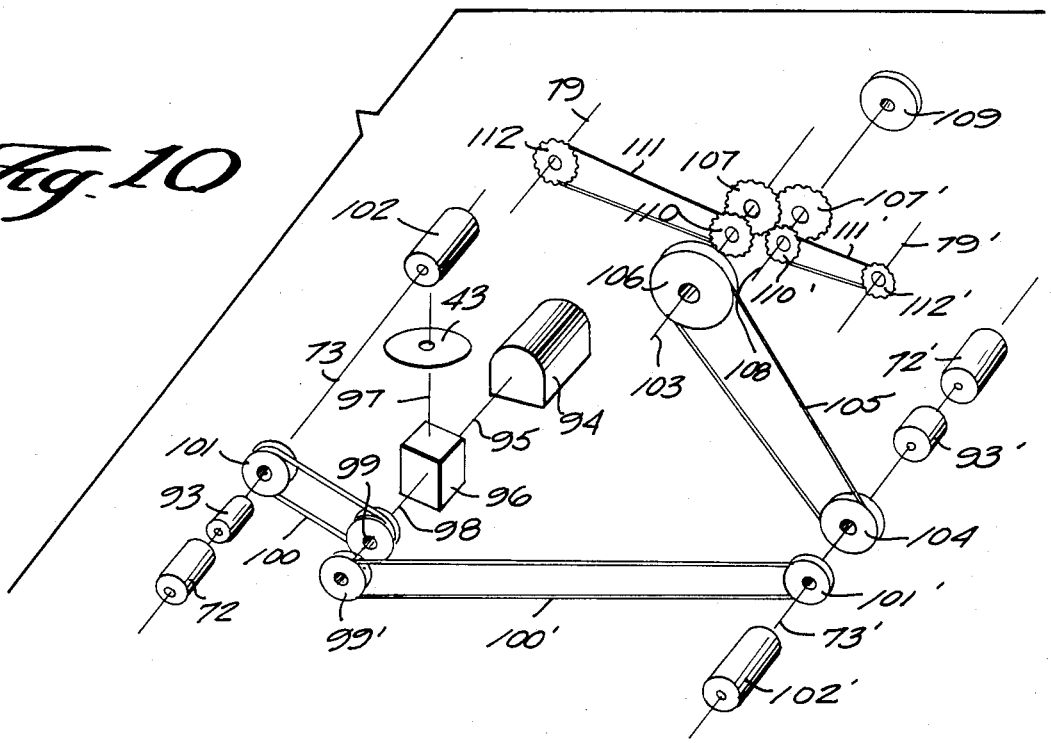
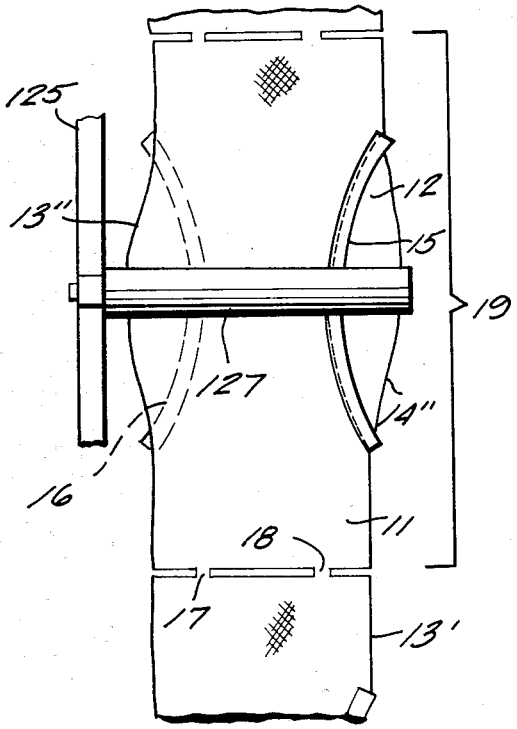
Fig. 13
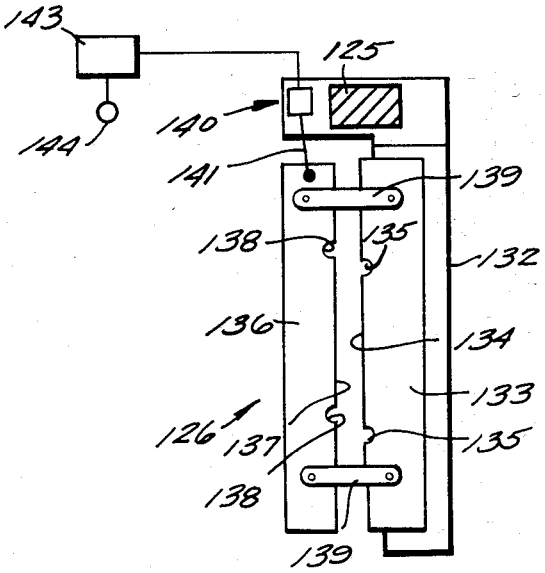
Fig. 14

CONSTRUCTION OF FLY PIECES FOR MEN'S BRIEFS

BACKGROUND AND SUMMARY OF THE INVENTION

In conventional commercial installations, the construction of the fly portion of men's briefs, or the like, is a time-consuming and labor-intensive procedure. Normally, individual fly pieces are formed manually, they are disposed in stacks manually, and an operator takes two fly pieces, making sure the bandstitched side portions thereof are in proper alignment, and then puts them together. If great care is not taken in the stacking and matching of the fly pieces, a high percentage of rejects can easily result.

According to the present invention, fly pieces for men's briefs or the like are produced in a much less time-consuming manner, utilizing automatic machinery that should substantially reduce the costs associated with production of the fly pieces, and substantially reduce the number of rejects. In the practice of a method of automatically producing such fly pieces, a number of novel pieces of equipment are utilized for automatically band-stitching arcuate side portions of the fly pieces with minimal waste of banding material; trimming the fly pieces; feeding the fly pieces; and collecting the fly pieces. According to the present invention, a coil of pairs of fly pieces—the components of the pairs being in perfect alignment, and the fly pieces being separated from the coil with a minimal effort—is provided as opposed to the stack of alternating fly pieces produced commercially at the present time.

The novel equipment utilized to practice the method according to the present invention will find other uses in the garment industry, although it is particularly adapted for efficiently and effectively producing fly pieces for men's briefs or the like.

It is the primary object of the present invention to provide for the efficient and effective production of fly pieces for men's briefs, or the like. This and other objects of the invention will become clear from an inspection of the detailed description of the invention and from the appended claims.

BRIEF DESCRIPTION OF THE DRAWINGS

FIG. 3 is a side schematic view illustrating the bunching apparatus of the machine of FIGS. 1 and 2;

FIG. 4 is a perspective schematic detail view illustrating the upstream cloth trimmer associated with automatic sewing machine of the apparatus of FIG. 1;

FIG. 5 is an end view of an exemplary trimming mechanism according to the present invention;

FIG. 9 is a schematic detail view showing an exemplary drive mechanism for the linearly reciprocal powered components of FIG. 6;

FIG. 10 is a diagrammatic view of the power components for driving the individual powered units of the apparatus of FIG. 1;

FIG. 11 is a top plan view illustrating the apparatus for effecting linear reciprocation of components of the apparatus of FIG. 1, only one component being shown in toto;

FIG. 12 is a side view of the coiling mechanism of the apparatus of FIG. 1;

FIG. 13 is a detail side view of a portion of the apparatus of FIG. 12, and showing appropriate registry in face-to-face relationship of partially severed sheets comprising the fly pieces formed according to the present invention; and FIG. 14 is a top plan schematic view of exemplary severing apparatus utilizable with the coiler of FIG. 12.

DETAILED DESCRIPTION OF THE DRAWINGS

Figure 1:
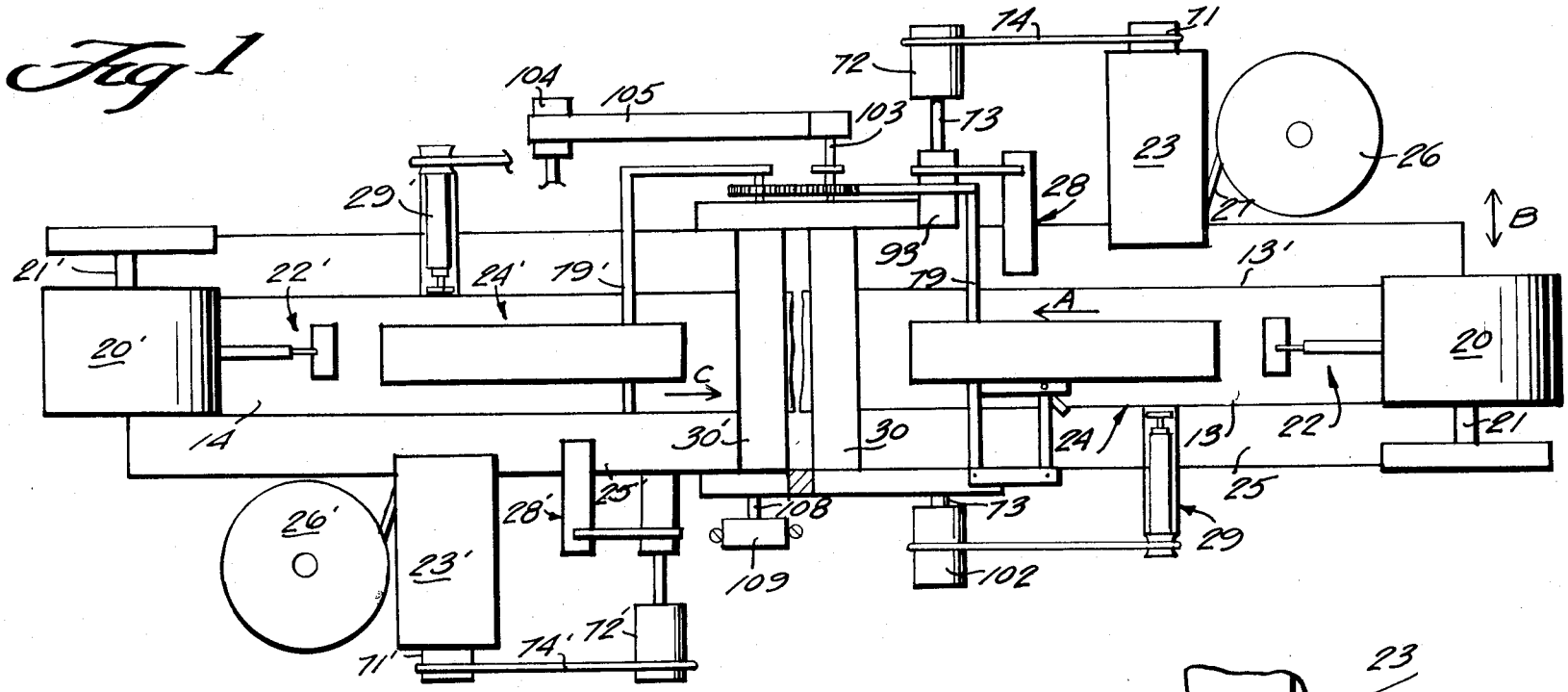
FIG. 1 is a top plan view, with only the coiler shown in section, of exemplary apparatus for practicing the method according to the present invention.

According to the present invention fly pieces for men's briefs are continuously produced to ultimately form a coil of pairs of fly pieces, the pairs in the coil being almost completely severed from the pairs adjacent thereto, and the fly pieces of the pairs being in perfect registry with each other. Such a coil is shown schematically by reference numeral 10 in FIG. 12, and the individual pairs of fly pieces are shown by reference numerals 11 and 12 in FIG. 13, in registry with each other, just prior to coiling.

The method according to the present invention is practiced by synchronously forming two sheets of fly pieces, 13, 14 (see FIG. 1), each sheet having alternating band-stitched arcuate side portions and non-band stitched relatively straight portions along a first side edge 13', 14' thereof. The arcuate band-stitched side portions are illustrated by reference numerals 15 and 16, for the sheets 13, 14, respectively, in FIG. 13. The sheets 13, 14 are combined together in face-to-face relationship (see FIG. 13) with the arcuate side portions 15, 16 aligned, but opposite each other. The face-to-face sheets 13, 14 are partially severed—for instance see very narrow connecting portions 17, 18 therebetween—to provide pairs of distinct fly pieces, a pair of distinct fly pieces being illustrated by reference numeral 19 in FIG. 13. Then the partially severed sheets are coiled into the roll 10, and when a complete roll 10 is formed the roll can be transferred to another station for manual, or automatic, final severing of the pairs of fly pieces 19 from each other, and sewing to form a fly for men's briefs.

The sheets 13, 14 are also preferably trimmed so that a bulge 13'', 14'' is formed therein on the opposite side edge of the sheets 13, 14, respectively, as the first edges 13, 14', and generally coincident with the band-stitched arcuate portions 15, 16, respectively, thereof.

With reference to FIG. 1, a pair of identical units are provided—disposed in mirror image relationship with respect to each other—for acting on the sheets 13, 14, until the sheets merge into the coiler. A synchronous driving mechanism, illustrated schematically in FIG. 10, provides for coordination of the units to effect the desired results. The components of the unit on the left side of the machine as viewed in FIG. 1 have the same reference numerals as the components of the unit on the right side, only the numerals are followed by a "'".

Each unit includes (see FIG. 1 in particular): a shaft 21, 21' for mounting a coil 20, 20' of a cloth sheet 13, 14, respectively, for rotation about a horizontal axis extending in dimension B. A cloth bunching mechansim 22, 22'. An automatic sewing machine 23, 23'. A conveying means 24, 24', including a generally flat surface 25, 25' disposed in a generally horizontal plane, for feeding the sheet (13, 14) in a horizontal direction A (in the case of sheet 13) or C (in the case of sheet 14), the directions A, C being perpendicular to the dimension B. A supply 26, 26' of banding material 27, 27' for feed to the automatic sewing machine 23, 23'. A trimming mechanism 28, 28' downstream of the automatic sewing machine 23, 23' in the direction of feed (A, C) of the cloth sheets (13, 14). A trimming mechanism 29, 29' opposite the automatic sewing machine 23, 23'. And, a horizontal, powered, elongated roller (or cylinder) 30, 30' mounted at the base of the coiling mechanism, the coiling mechanism being common to the two units and illustrated generally by reference numeral 31 (see FIG. 12).

Generally, the components of only one of the units will be described hereafter, it being understood that the corresponding components of the other unit are identical.

Figure 2:
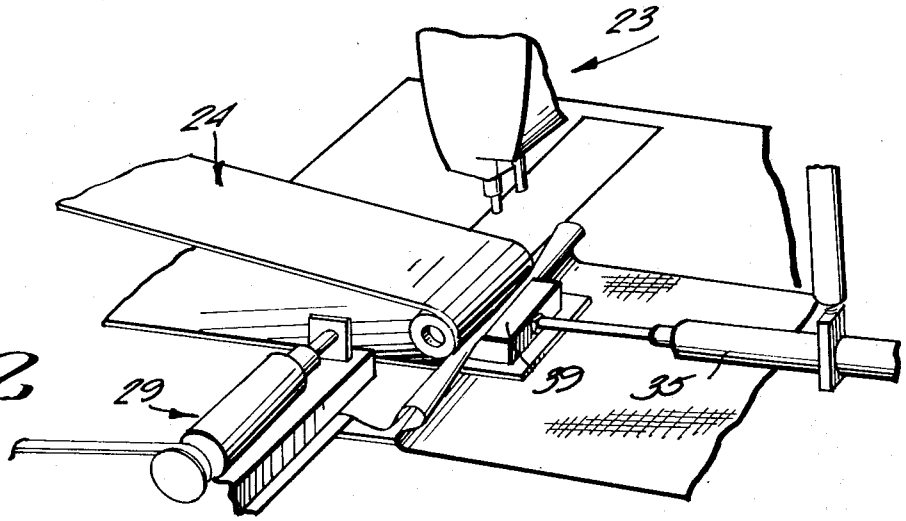
FIG. 2 is a top perspective view of one of the two basic units of the apparatus of FIG. 1, shown during bunching or folding of the cloth being acted upon.

The cloth bunching or folding means 22 is seen in operation in FIG. 2 (cooperating with the conveying means 24 which continuously pulls cloth in dimension A from the roll mounted for rotation about shaft 21), and is shown in inoperative position in FIG. 3. The mechanism 22 preferably comprises first and second piston and cylinder assemblies, the first piston and cylinder assembly comprisng a generally vertically oriented cylinder 33 and a piston rod 34, and the second piston and cylinder assembly comprising a generally horizontally oriented cylinder 35 and piston rod 36. The cylinder 33 is mounted by bracket 36 to a stationary frame component, and the cylinder 35 is pivotally mounted—for rotation about a horizontal axis in dimension B—by bracket 37 to a stationary frame component. The piston rod 34 is pivotally connected at 38 to an intermediate portion of cylinder 35, and a cloth-engaging component (preferably a plate) 39 is rigidly connected to the end of piston rod 36.

Preferably the pistons of piston rods 34, 36 are pneumatically operated from a common source 40. The effective operational area of the piston of rod 34 is less than the effective operational area of the piston or rod 36 so that the piston rod 34 will be extended (to move the component 39 into engagement with the cloth) before the rod 36 is extended to effect "bunching-up" of the cloth. Rod 36 moves more quickly in direction A than the cloth 13 under the power of conveying means 24, to effect "bunching". Fluid from source 40 is supplied to cylinders 33, 35 simultaneously upon operation of an actuator, which actuator includes a cam follower 41 (see FIG. 3) which preferably engages an upstanding portion 42 (see FIG. 11) on a cam 43.

As is conventional, the automatic sewing machine 23 includes a reciprocating needle assembly 44 (see FIG. 4). The machine 23 may be of any conventional type, such as a Union Special. In order to ensure that the side edge 13' of the cloth sheet 13 is trimmed properly (so that the banded-stitched side portion 15 does not bulge), an upstream cutting assembly, shown generally by reference numeral 45 in FIG. 4, is provided. This cutting assembly 45 may include a blade portion 46 having a sharp edge 47, and mounted for rotation about a pivot pin 48 extending in the dimension B, rotation of the blade 46 about pivot pin 48 being effected by cooperation between actuator arm 49 and actuating yoke 50. The yoke 50 is mounted to the reciprocating needly assembly 44 of the automatic sewing machine 23, and engages arm 49 during each downward stroke to effect pivoting cutting action of blade 46. A stationary edge 48 substantially coplanar with support surface 25 cooperates with the blade edge 47 to effect trimming of the cloth sheet, and a conventional vacuum unit 51 may be provided for removing trimmed cloth. The arm 49 may be spring-biased into engage with yoke 50.

Another cloth trimming mechanism according to the present invention is illustrated schematically in FIG. 5, and this basic mechanism may be utilized as a downstream cutter 28, or a cutter 29 opposite the automatic sewing machine 23. In each case, a block 53 has means defining a vertical rectangular (in cross-section) passageway therethrough, in which the rectangular cross-section blade 54 is guided for vertical reciprocatory movement. The blade 54 has a sharp edge 55 which cooperates with a stationary edge 56 associated with the cutter, to effect trimming of the edges of the cloth sheet (in the case of a cutter 29) or the banding material 27 exterior of the sheet edge 13' (in the case of a cutter 28). The blade 54 includes means defining an elongated passageway 57 therein which receives a pin 58 eccentrically mounted with respect to a powered shaft 59, the shaft rotatable about an axis in the dimension B. Rotation of shaft 59 thus imparts reciprocal vertical cutting movement to the blade 54.

Figure 6:
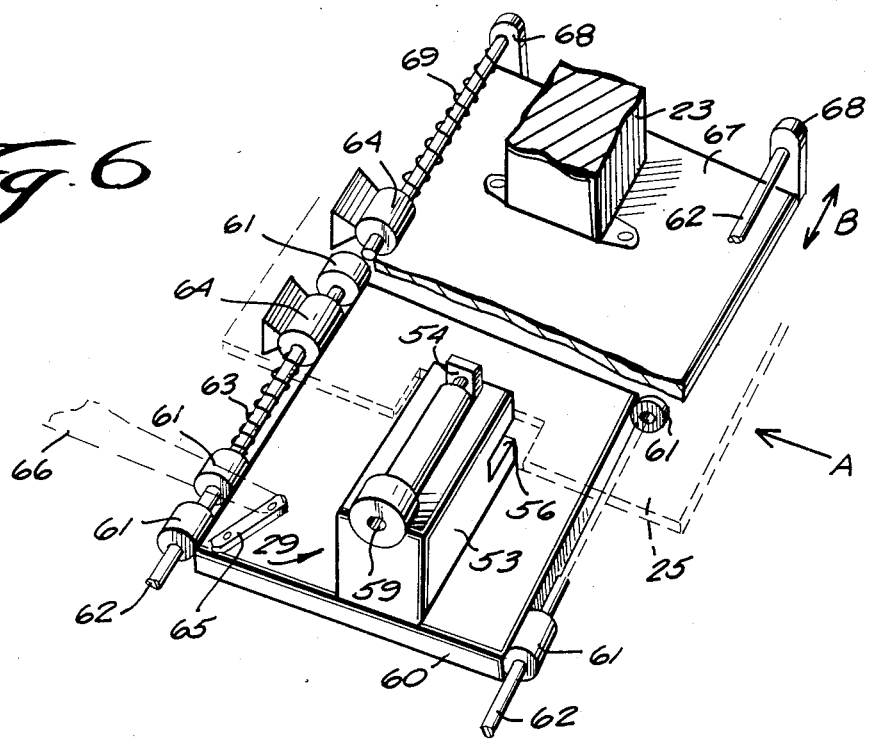
FIG. 6 is a perspective schematic view, with many components cut away for clarity, of the carriages for mounting various components of the apparatus of FIG. 1 for linear reciprocal movement.

As seen most clearly in FIG. 6, the automatic sewing machine 23 and the trimmer 29 are mounted for vertical reciprocatory movement in dimension B. With respect to cutter 29, this is preferably accomplished by mounting the block 53 to a platform 60, which includes tubular guide collars 61 located at various positions thereof for receipt of guide rods 62. A spring 63 mounted between a stationary collar 64 and one of the collars 61 normally biases the platform 60 to an outward position with respect to the surface 25. Force is applied to the platform 60 to move it in dimension B against the bias of spring 63 by a lever 65 pivotally connected at one end thereof to the top of platform 60 and at the other end thereof to a cam follower arm 66, which will be explained in more detail with respect to FIG. 11.

The automatic sewing machine 23 is mounted on a platform 67 similar to platform 60, but distinct therefrom. For clarity of illustration, platforms 60, 67 in FIG. 6 are shown closer together than they actual would be. While the operation of the platform 67 is distinct from that of platform 60, the platform 67 may have its own collars 68 which receive the same guide rods 62, and a spring 69 may be provided between a collar 68 and stationary collar 64 to bias the platform 67 outwardly with respect to the surface 25. A lever assembly (not shown) comparable to the lever and cam follower 65, 66 is provided for the platform 67 to effect linear reciprocation thereof in dimension B.

In order to provide for the powering of the shaft 59 and sewing machine 23 continuously during the entire time that they are being linearly reciprocated in dimension B, a powering mechanism such as illustrated in FIG. 9 is shown. While the powering mechanism in FIG. 9 is shown specifically with respect to sewing machine 23, it is to be understood that it is equally applicable to the trimming mechanisms 29. The powering mechanism includes a driven pulley 71 operatively associated with the sewing machine 23 for powering the components thereof, the pulley 71 rotatable about an axis extending in dimension B. The powering mechanism further comprises a smooth-surfaces cylinder 72 elongated in the dimension B, and having an effective length in the dimension B longer than the path of linear reciprocation in dimension B. The cylinder 72 is mounted on a powered shaft 73 associated with the drive mechanism for the entire apparatus (see FIG. 10). Connected between the pulley 71 and cylinder 72 is a flexible belt 74, which preferably is circular in cross-section, and may be made of urethane. Since the shaft 73 will always be rotating during linear reciprocation of the sewing machine 23, there is little frictional resistance in the dimension B, and the belt 74 moves smoothly along the surface of the cylinder 72.

Figure 7:
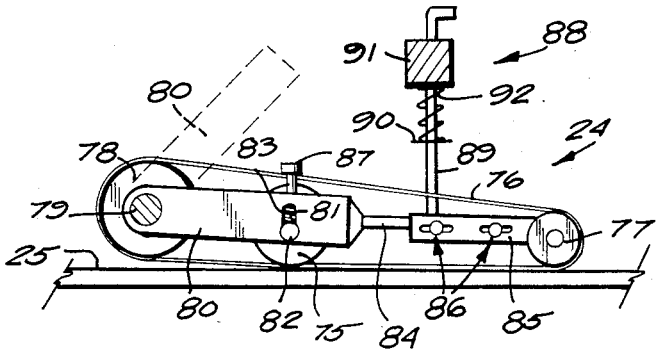
FIG. 7 is a side view of an exemplary conveying apparatus according to the present invention.
Figure 8:
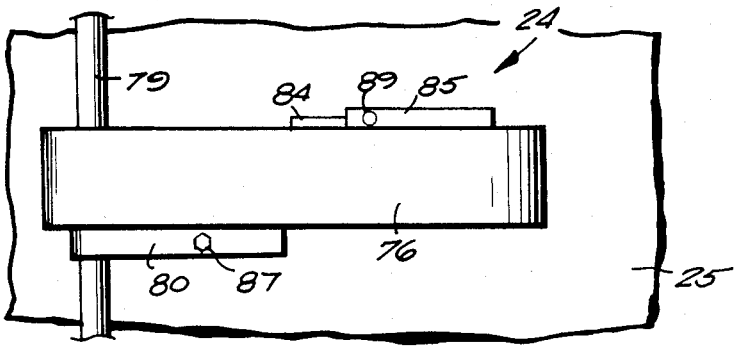
FIG. 8 is a top plan view of the apparatus of FIG. 7.

The conveying means 24 are shown most clearly in FIGS. 7 and 8, and include—in addition to the flat surface 25—a conveyor belt 76 in operative tangential engagement with first, second, and third rollers 77, 78, 75, respectively. The second roller 78 is mounted at the trailing edge of the assembly 24, and is powered by shaft 79. When the apparatus is turned off, the entire assembly 24 may be pivoted upwardly—as indicated by dotted line in FIG. 7—about the shaft 79, which shaft 79 extends in dimension B. The second roller 78 is mounted by shaft 79 so that it is always spaced a significant distance from the surface 25. However, the first and third rollers 77, 75 are mounted so that they are normally—through the portion of conveyor belt 76 extending therebetween—in operative engagement with the surface 25.

The roller 75 preferably is mounted by a yoke 80, which receives shaft 79 by a bearing at one end thereof, and includes means defining a vertically elongated opening 81 therein for receipt of the shaft pin 82 about which the third roller 75 is rotatable. A spring 83 acts between the top surface of opening 81 and the top of shaft pin 82 to provide downward bias to the third roller 75, urging toward the surface 15. Screw 87 acts on spring 83 to vary the tension thereof. An extension 84 of yoke 80 telescopically receives a sleeve arm 85 which operatively mounts the first roller 77 for rotation about an axis extending in dimension B. Conventional adjustment slot and screws—indicated generally by reference numeral 86 in FIG. 7—may be provided for adjusting the distance between the rollers 77, 75.

Further spring-biasing of the conveyor 76 and rollers 77, 75 into operative association with the surface 25 is provided by the mechanism indicated generally by reference numeral 88 in FIG. 7. This mechanism includes a vertically extending pin 89 having a collar 90 and passing through a vertically extending opening in a solid arm 91. A spring 92 acts between the arm 91 and the collar 94 biasing the pin 89 downwardly, and in the operative position the pin 89 overlays an exterior portion of the sleeve 85, as illustrated in FIG. 8. The arm 91 preferably is mounted for pivtal movement about a vertical axis so that the entire structure 88 can be moved out of the way to allow pivoting of the entire assembly 24 about shaft 79, to an inoperative position (see dotted lines in FIG. 7). The spring-biasing of the belt 76 provides for good frictional engagement thereof with the cloth sheet 13 to move the cloth sheet 13 in direction A, but also allows folded-over or "bunched-up" sections of cloth to pass between belt 76 and surface 25 with adversely affecting operation of the conveying action.

The downstream cutters 28, although not linearly reciprocated during normal operation, are preferably mounted for adjustment in the dimension B, it being possible to tighten them down in the position to which they have been adjusted utilizing screws, or the like. In this way, various widths of sheets 13 may be accommodated. For this reason, the drive powering the trimmers 28 also includes an elongated cylinder, e.g., cylinders 93.

Preferably a common drive is provided for the entire apparatus, and significant features of this drive are illustrated diagrammatically in FIG. 10. A single electric motor 94 powers a shaft 95 leading into a gear box 96. The gear box 96 is conventional, and provides an adjustable output, as is also conventional. Extending upwardly from the gear box 96 is vertical shaft 97 which mounts cam 43, and extending horizontally from the opposite side of gear box 96 as shaft 95 is shaft 98. Pulleys 99, 99' mounted with shaft 98 power the shafts 73, 73', respectively, through belts 100, 100' and pulleys 101, 101'. The shafts 73, 73' also mount the elongated smooth-surfaced rollers 102, 102' for powering the trimming means 29, 29'.

The rollers 30, 30' and shafts 79, 79' are preferably powered by a shaft 103, which receives its power from pulley 104 (connected to shaft 73'), belt 105, and pulley 106 mounted on shaft 103. Gear 107 is mounted on shaft 103, and intermeshes with gear 107' mounted on shaft 108. Pulley 109, for powering the coiler 31, also is mounted on shaft 108. Sprockets 110, 110' are mounted on shafts 103, 108, respectively, and through chains 111, 111' and sprockets 112, 112' power conveyor shafts 79, 79'.

The cam 43, and associated components, is responsible for synchronizing the linear reciprocal movement of the sewing machines 23, 23' and trimmers 29, 29' in dimension B with the feed of the cloth, to provide the desired fly piece formation. The cam 43 is seen most clearly in FIGS. 10 and 11, and as seen in FIG. 11, cam 43 acts on cam follower 66—and associated cam followers operatively mounted with platform 67, 60' and 67'—to effect reciprocation of the sewing machines 23, 23' and trimmers 29, 29'. Only cam follower 66 will be described, with respect to FIG. 11, however it is understood that the other cam followers are similarly disposed.

Cam follower 66 is mounted for pivotal movement about a vertical axis by pin 114, which in turn is mounted on arm 115 of disc 116. The disc 116 is normally stationary, having a central bearing thereof receiving the shaft 97, however by appropriate action the arcuate position of the disc 116 with respect to shaft 97—and of the position of arm 115 thereof—may be adjusted. Of course adjusting the position of arm 115 adjusts the manner of cooperation between cam 43 and cam follower 66, and thus controls the extent of the path of linear reciprocation of the platform 60 (depending upon the width of the sheet 13 to be acted upon). The speed of rotation of the shaft 97 is controlled by adjusting the gear box 96, and this thus adjusts the length of the garment being made (i.e., the differential speed between shaft 97 and shaft 98 may be changed). Adjustment of the arcuate position of plate 116 may be effected utilizing the adjustment mechanism 117. Threaded rod 118 is received by interiorly threaded stationary component 119, and thus conical tip 120 of rod 118 may be reciprocated linearly in a direction radial with respect to shaft 97. By engaging interior surface 121 of plate 116, the linear position of the conical component 120 is transformed into an arcuate position adjustment of the plate 116.

Arm 122 of plate 116 is operatively connected to the cam follower associated with platform 60'. Plate 116' is identical to plate 116 (it is shown larger in FIG. 11 merely for clarity, and normally would be the same size as plate 116), and arms 115', 122' thereof are, respectively, operatively connected to the cam followers for moving platforms 67, 67'. The positioning of cam surface 42 on cam 43 also coordinates the operation of the cloth bunching mechanism 22 with the other components.

The coiler 31 is best seen in FIGS. 12 through 14, and includes a vertically extending mounting bar 125 which supports a sheet partial-severing mechansim (shown generally by reference numeral 126 in FIG. 14), a pair of guide rollers 127, 127' rotatable about horizontal axes extending in dimension B, and a powered, shaft 128 at the top of bar 125 for effecting coiling. The shaft 128 is powered by pulley 109 through urethane belt 129, and pulley 130 (connected to the end of shaft 128). Belt 129 is shown partially in cross-section, and partially in elevation, in FIG. 12.

The partial-severing mechanism 126 includes a stationary bracket 132 mounted by bar 125 to which a stationary blade 133 is mounted. The blade 133 includes a sharp edge 134 with a pair of inoperative portions—i.e., notches 135—spaced therealong. Movable blade 136, which includes sharp edge 137 with notches 138 corresponding to the notches 135, may be moved in any manner relative to the blade 133 to effect the partial severing action. Preferably the relative movement therebetween is accomplished by mounting the blades 133, 136 in a parallelogram linkage utilizing levers 139 pivotally mounted to each of blades 133, 136, and by using a pneumatic piston and cylinder assembly—shown generally by reference numeral 140 in FIG. 14—for effecting movement. Piston rod 141 of assembly 140 is pivotally mounted to blade 136, and linear movement of rod 141 is transformed into scissors-type cutting action between the blade edges 134, 137, which receive the sheets 13, 14 therebetween. The cutting action provides partial severing of the sheets 13, 14, leaving only thin sections 17, 18 between adjacent fly pieces 19 (see FIG. 13).

Piston and cylinder assembly 140 is supplied with air from source 143, a switch activated by cam follower 144 allowing passage of air from source 143 to assembly 140. The cam follower 144 is mounted for engagement by cam 42, so again synchronous action of all of the component parts of the apparatus according to the present invention is provided by the common powering mechanisms illustrated in FIGS. 10 and 11.

In order to allow the motor 94 to run at all time, while being able to selectively stop operation of the machine, a pneumatic clutch can be provided for motor 94, and by simply throwing a manual pneumatic switch, power for the entire mechanism can be selectively cut in and out.

Operation

In operation of the apparatus heretofore described, cloth sheets 13, 14 will be withdrawn from the spools of cloth 20, 20' and moved in directions A, C, respectively. Movement in the directions A, C will be powered under the influence of conveying means 24, 24'. Through operation of the common power and synchronizing means illustrated in FIGS. 10 and 11, the sewing machines 23, 23' and the trimmers 29, 29' will move in dimension B to contour the edges 13', 13'' and 14', 14'' of the sheets 13, 14 to form the band-stitched arcuate side portions 15, 16, and bulges 13'', 14'' as illustrated in FIG. 13. Cutters 28, 28' trim off any excess banding material 27, and bunching mechanisms 22, 22' operate so that upon completion of an arcuate band-stitch portion 15, 16 the sheets 13, 14 will be folded-up, to minimize waste of banding material 27. Cutters 45, 45' will ensure that the edges 13', 14' are trimmed properly to allow banding without bulges.

After the sewing and trimming operations, the sheets 13, 14 have the direction of travel thereof changed by powered rollers 30, 30, from horizontally to vertically upwardly. Powered coiler shaft 128 takes up the sheets 13, 14 as they are guided through rollers 127, 127', and piston and cylinder assembly 140 is actuated and sync with the rest of the components to effect partial severing of the sheets 13, 14 when they are in face-to-face engagement (as illustrated in FIG. 13) to form the pair of fly pieces 19. When a complete coil 10 of fly pieces is formed, it is removed and a new coil is started.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. Apparatus for constructing fly pieces of men's briefs or the like, comprising:

means for simultaneously and synchronously forming two sheets of fly pieces, each having alternating band-stitched arcuate side portions and non-band-stitched straight portions along a first edge thereof;

means for combining said sheets together in face-to-face relationship with the first side of one sheet opposite the first side of the other sheet;

means for partially severing the sheets when in face-to-face relationship, into distinct fly pieces; and means for coiling the partially severed sheet into a roll of a plurality of pairs of fly pieces.

2. Apparatus as recited in claim 1 wherein said means for synchronously forming two sheets of fly pieces comprise a pair of indentical forming units disposed in mirror image relationship, and a central synchronous control for said forming units.

3. Apparatus as recited in claim 2 wherein each of said forming units comprises: means for continuously feeding a sheet in a horizontal direction; an automatic sewing machine; means for mounting said automatic sewing machine for reciprocation in a horizontal dimension perpendicular to said direction of sheet feed, into and out of operative association with the first side of said sheet; means for feeding banding material into operative association with said automatic sewing machine, and said sheet; and means for trimming banding material outside the first side of said sheet downstream of said automatic sewing machine in the direction of sheet feed.

4. Apparatus as recited in claim 3 further comprising: means, for periodically effecting bunching-up of sheet material being continuously fed past the automatic sewing machine; and means for synchronizing said bunching-up so that it occurs after completion of a band-stitched arcuate side portion of the sheet first side, so that waste of banding material is minimized.

5. Apparatus as recited in claim 4 wherein said bunching-up means comprises: a first, generally vertically oriented, piston and cylinder assembly, including a piston rod; a second, generally horizontally oriented, piston and cylinder assembly, including a piston rod; said cylinder of said second piston and cylinder assembly being pivotally connected to a stationary mounting structure, for pivotal movement about a horizontal axis perpendicular to the direction of feed of said sheet, at the opposite end thereof as the piston rod of said second cylinder assembly; means for pivotally mounting the piston rod of said first piston and cylinder assembly to a central portion of the cylinder of said second piston and cylinder assembly, for effecting pivotal movement of said second piston and cylinder assembly cylinder about its horizontal axis; and a cloth-engaging component mounted to the end of the piston rod of said second piston and cylinder assembly.

6. Apparatus as recited in claim 5 wherein the effective operational area of the piston of said first piston and cylinder assembly is smaller than the effective operational area of the piston of said second piston and cylinder assembly; and means for operatively connecting said cylinders of both said first and second piston and cylinder assemblies to a common fluid source so that said first piston and cylinder assembly is actuated slightly before said second piston and cylinder assembly.

7. Apparatus as recited in claim 3 wherein said means for feeding said sheet includes: a conveyor belt assembly having one end thereof slightly upstream of the operative area of said automatic sewing machine, and having the other end thereof substantially downstream of said automatic sewing machine; a first roller at said first end thereof; a second roller at said second end thereof; a third roller disposed intermediate said first and second ends thereof; a conveyor belt; means for mounting each of said rollers with respect to each other and said conveyor so that said conveyor belt tangentially engages each of said first, second, and third rollers; a substantially flat support surface disposed in a substantially horizontal plane; means for mounting said second roller so that it is at all times operatively spaced from said flat surface; and means for spring-biasing said first and third rollers, and a portion of the moving conveyor belt extending therebetween, into operative association with said flat surface.

8. Apparatus as recited in claim 7 wherein said spring-biasing means comprises a support for mounting said third roller for rotation about a horizontal axis perpendicular to the direction of feed of the sheet; means defining a vertically elongated opening in said support for receipt of a shaft of said third roller, said shaft having dimensions substantially less than the dimensions of said opening; and a spring engaging an interior portion of said support opening and engaging said shaft, and biasing said shaft downwardly.

9. Apparatus as recited in claim 8 wherein said spring-biasing means comprises an adjustable length support arm operatively extending between said third and said first rollers for supporting said first roller for rotation about a horizontal axis perpendicular to the feed direction of said sheet; a vertically extending pin; a support arm mounted above said conveyor assembly; and spring means acting between said support arm and said pin for biasing said pin into engagement with said adjustable length support arm for biasing said support arm, and the said first and third rollers, downwardly.

10. Apparatus as recited in claim 7 wherein said spring-biasing means comprises an adjustable length support arm operatively extending between said third and said first rollers for supporting said first roller for rotation about a horizontal axis perpendicular to the feed direction of said sheet; a vertically extending pin; a support arm mounted above said conveyor assembly; and spring means acting between said support arm and said pin for biasing said pin into engagement with said adjustable length support arm for biasing said support arm, and the said first and third rollers, downwardly.

11. Apparatus as recited in claim 3 further comprising drive means for continuously powering the stitching action of said automatic sewing machine during reciprocation of said sewing machine in a dimension perpendicular to the dimension of sheet feed, said drive means comprising: a driven pulley associated with said automatic sewing machine; a smooth-surfaced drive roller, said drive roller elongated in the dimension of reciprocation of said automatic sewing machine a distance greater than the total effective movement of said automatic sewing machine in said dimension of reciprocation thereof; and a flexible drive belt extending between said drive roller and said pulley.

12. Apparatus as recited in claim 11 wherein said drive belt is circular in cross-section.

13. Apparatus as recited in claim 12 wherein said drive belt is of urethane.

14. Apparatus as recited in claim 2 wherein each of said units includes means for reciprocating driven components thereof in a dimension opposite the direction of feed of said sheet; and further comprising powering means for powering said reciprocated components, each powering means comprising a driven pulley associated with said component; a smooth-surfaced drive roller elongated in the dimension of reciprocation of the component; and a flexible belt interconnecting said drive roller and driven pulley.

15. Apparatus as recited in claim 14 wherein said drive belt is circular in cross-section.

16. Apparatus as recited in claim 15 wherein said drive belt is of urethane.

17. Apparatus as recited in claim 3 further comprising trimming means for trimming a side of said sheet; means for mounting said trimming means opposite said automatic sewing machine to trim the side of said sheet opposite said first side thereof; and means for reciprocating said trimming means in the same dimension as said automatic sewing machine reciprocation dimension; said synchronous control synchronizing the reciprocation of said trimming means and the automatic sewing machine.

18. Apparatus as recited in claim 1 further comprising trimming means for trimming side portions of said sheet, said trimming means comprising a stationary mounting block; means defining a vertical through-extending opening in said mounting block; a cutting blade mounted for guided vertical reciprocating movement in said mounting block opening; means defining a horizontally through-extending opening in said cutting blade; a horizontal powered rotating shaft and an eccentric operatively connected to said shaft and disposed in operative association with said horizontal opening in said cutting blade so that upon rotation of said shaft said cutting blade is reciprocated up and down.

19. Apparatus for effecting arcuate stitching of bonding material to an edge of cloth, comprising:

an automatic sewing machine;

means for feeding cloth in a first horizontal direction past, and into operative association with, said automatic sewing machine;

means for feeding bonding material into operative association with said automatic sewing machine;

means for effecting linear reciprocation of said horizontal sewing machine in a second horizontal dimension, perpendicular to said first horizontal direction during stitching of said bonding material to an edge of said cloth; and drive means for effecting continuous operation of stitching action of said automatic sewing machine continuously during its linear reciprocation in said second dimension; said drive means comprising: a driven pulley operatively associated with said automatic sewing machine; a smooth-surfaced cylindrical drive roller elongated in said second dimension, and having an effective length greater than the length of the path of linear reciprocation of said automatic sewing machine; and a flexible belt interconnecting said roller and pulley.

20. Apparatus as recited in claim 19 wherein said drive belt is circular in cross-section.

21. Apparatus as recited in claim 20 wherein said drive belt is of urethane.

22. Apparatus for effecting arcuate stitching of bonding material to an edge of cloth, comprising:

an automatic sewing machine;

means for feeding cloth in a first horizontal direction past, and into operative association with, said automatic sewing machine;

means for feeding bonding material into operative association with said automatic sewing machine;

means for effecting linear reciprocation of said horizontal sewing machine in a second horizontal dimension, perpendicular to said first horizontal direction during stitching of said bonding material to an edge of said cloth;

drive means for effecting continuous operation of stitching action of said automatic sewing machine continuously during its linear reciprocation in said second dimension;

a second automatic sewing machine;

means for feeding cloth in a third horizontal direction past, and into operative association with, said second automatic sewing machine;

means for feeding bonding material into operative association with said second automatic sewing machine;

means for effecting linear reciprocation of said second sewing machine in a fourth horizontal dimension, perpendicular to said third horizontal direction, during stitching of said bonding material to an edge of said cloth; and drive means for effecting continuous operation of stitching action of said second automatic sewing machine continuously during its linear reciprocation in said fourth dimension.

23. Apparatus as recited in claim 22 wherein said means for effecting linear reciprocation of said sewing machine in a second horizontal dimension, and said second sewing machine in a fourth horizontal dimension, comprises a single mechanical cam means.

24. Apparatus as recited in claim 23 further comprising a single screw adjustment means for changing the pivot point of said mechanical cam means so as to modify the position of said sewing machine and said second sewing machine in the second and fourth dimensions, respectively, to adjust the workpiece width capabilities of the apparatus.

25. Apparatus as recited in claim 23 further comprising trimming means for trimming cloth fed in said first horizontal direction, and said third horizontal direction; means for mounting said trimming means opposite a said automatic sewing machine to trim the side of said sheet opposite the side adjacent said sewing machine; and means for reciprocating said trimming means in the same dimension as its respective automatic sewing machine; said cam means comprising said means for reciprocating said trimming means.

26. Apparatus as recited in claim 1 wherein said means for combining, means for partially severing, and means for coiling said sheets comprise means for forming a roll of a plurality of pairs of fly pieces so that the rolled fly pieces are matched and thereby the presentation of the fly pieces to a subsequent sewing operation is facilitated.

27. Apparatus as recited in claim 3 wherein each of said forming units further comprises means for reciprocating said trimming means in a horizontal dimension perpendicular to said direction of sheet feed; and means for reciprocating said sewing machine; and further comprising a single mechanical cam means for effecting reciprocation of said sewing machines and said trimming means.

28. Apparatus as recited in claim 27 further comprising a single screw adjustment means for changing the pivot point of said mechanical cam means so as to modify the positions of said sewing machines to adjust the workpiece width capabilities of the apparatus.

29. Apparatus as recited in claim 2 in each of said forming units comprises: means for continuously feeding a sheet in a horizontal direction; an automatic sewing machine; means for mounting said automatic sewing machine for reciprocation in a horizontal dimension generally perpendicular to said direction of sheet feed, into and out of operative association with the first side of said sheet; means for effecting reciprocation of said automatic sewing machines; and means for feeding bonding material into operative association with each said automatic sewing machine, and said sheet; and further comprising a single cam means for synchronizing reciprocation of said automatic sewing machines of said forming units.

30. Apparatus as recited in claim 29 further comprising a single screw adjustment means for changing the pivot point of said mechanical cam means so as to modify the position of said sewing machines to adjust the workpiece width capabilities of the apparatus.

* * * * *